US005353496A

United States Patent [19]

Harman et al.

[11] Patent Number: 5,353,496

[45] Date of Patent: Oct. 11, 1994

[54] MECHANICAL TUBE EXPANDER WITH FOUR AXIS CONTROL

[75] Inventors: Galen B. Harman, La Grange, Ind.; James G. Milliman, Fawn River Township, St. Joseph County; Derrick S. Small, Sturgis, both of Mich.

[73] Assignee: Burr Oak Tool & Gauge Company, Sturgis, Mich.

[21] Appl. No.: 103,731

[22] Filed: Aug. 6, 1993

Related U.S. Application Data

[63] Continuation of Ser. No. 898,215, Jun. 12, 1992, abandoned.

[51] Int. Cl.[5] ..... B23P 15/26

[52] U.S. Cl. ..... 29/727; 29/723; 29/898.047

[58] Field of Search ..... 29/726, 727, 723, 890.047; 72/407

[56] References Cited

U.S. PATENT DOCUMENTS

| | | | |
|---|---|---|---|
| 3,688,533 | 9/1972 | Ames | 29/727 |
| 4,584,765 | 4/1986 | Gray | 29/727 |
| 4,597,171 | 7/1986 | Kitayama et al. | 29/727 |
| 4,780,955 | 11/1988 | Stromp | 29/727 |
| 4,835,828 | 6/1989 | York et al. | 29/157.3 |
| 4,839,950 | 6/1989 | Stromp | 29/727 |
| 5,003,691 | 4/1991 | Milliman et al. | 29/727 |

*Primary Examiner*—Irene Cuda

*Attorney, Agent, or Firm*—Flynn, Thiel, Boutell & Tanis

[57] ABSTRACT

A mechanical tube expander for simultaneously expanding plural hairpin tubes into interlocked relationship with plural fins which includes a frame on which is provided a receiver to support the bent portions of the hairpin tubes in an assembly of fins loosely stacked on the straight leg portions of the hairpin tubes. A support structure is also provided on the frame for engaging and supporting a first endmost fin that is oriented immediately adjacent to but spaced from the receiver. A pressure plate carrying a plurality of expander rods is provided and each of the expander rods is aligned with the hairpin tubes. A stripper plate structure having plural guide openings therethrough is also provided. The expander rods extend through the guide openings. Structure is provided on the stripper plate for engaging a second endmost sheet of the assembly of fins at an end thereof which is remote from the receiver. Separate drive devices are provided for effecting a selective and coordinated movement of each of the pressure plate, the stripper plate structure and the support structure relative to each other and in response to a movement of the expander rods and the tube expanding structure thereon into the straight leg portions of the hairpin tubes which effects an enlarging of the diameter of the straight leg portions to effect a fixing of each of the fins to the hairpin tubes.

18 Claims, 12 Drawing Sheets

MECHANICAL TUBE EXPANDER WITH FOUR AXIS CONTROL

This application is a continuation of U.S. Ser. No. 07/898,215, filed Jun. 12, 1992, now abandoned.

FIELD OF THE INVENTION

This invention relates to a mechanical tube expander and, more particularly, to a mechanical tube expander having structure thereon for facilitating a selective and coordinated movement of each of a pressure plate, a stripper plate and a support structure for an endmost fin or end sheet in an assembly of fins relative to each other and in response to a movement of the expander rods and the tube expanding structure thereon into the straight leg portions of the hairpin tubes or straight tubes which effects an enlarging of the diameter of the straight leg portions to effect a fixing of each of the fins to the hairpin tubes or straight tubes.

BACKGROUND OF THE INVENTION

Tube and fin type heat exchangers employing hairpin tubes (U tubes) or straight tubes are assembled into a mechanical tube expander by expanding the tubes into interference fit with the fins and end sheets of the heat exchanger. The hairpin tubes (U tubes) are comprised of two straight legs and a bend which is bent through an arc of 180°. The length of the two straight legs usually determines the number of fins that are to be stacked one on top of the other and laced through holes provided in the fins.

One of the problems associated with a taking of an assembly of fins loosely stacked on the straight leg portions of the hairpin tubes and effecting a fixing of each of the fins to the hairpin tubes has been controlling the position at which each of the fins individually becomes affixed to the straight leg portion of the hairpin tubes. If one of the fins becomes affixed to the tube prematurely or not soon enough, a gap will form between mutually adjacent fins or mutually adjacent fins will be pushed into tighter relationship with one another and appear to be crushed (or may even be crushed) when viewed from the side edges of the fins. Further, the amount of stick out of the distal end of the straight leg portions of the hairpin tubes beyond the endmost fin remote from the 180° bend is oftentimes uneven due to the crushing of the fin pack and not satisfactory to the customer purchasing the assembled coil. In addition, the length of the straight leg portions are known to shrink as the straight leg portions are expanded. This known shrinkage factor is further complicated by a growth in the height of the fin pack or coil height dimension as the tubes are expanded. These complicated relationships have resulted in undesired crushing of the fin pack, especially when the consistency in the material of the tubes varies. Thus, an apparatus which will effect an assembly of fins onto the straight leg portions of hairpin tubes and avoid the disadvantages mentioned above is deemed desirable.

Accordingly, it is an object of this invention to provide a mechanical tube expander having separate drive means for effecting a selective and coordinated movement of each of the pressure plate, the stripper plate and a support structure for an endmost fin in an assembly of fins relative to each other and in response to a movement of the expander rods and the tube expanding structure thereon into the straight leg portions of the tubes which effects an enlarging of the diameter of the straight leg portions to effect a fixing of each of the fins to the hairpin tubes.

It is a further object of this invention to provide a mechanical tube expander, as aforesaid, which has a control panel having controls thereon enabling the operator to set up the machine for differing coil heights while remaining at the control panel.

It is a further object of this invention to provide a mechanical tube expander, as aforesaid, wherein structure is provided for compensating for the shrinkage of the length of the straight leg portions and the simultaneous growth in the height dimension of the fin pack or coil height.

It is a further object of this invention to provide a mechanical tube expander, as aforesaid, wherein the separate drive means for effecting a selective and coordinated movement of each of the pressure plate, the stripper plate and the support for an endmost fin or end sheet is precisely controlled by a preprogrammed control circuit precisely moving each of the aforesaid pressure plate, stripper plate and support structure at precisely the correct rate of speed and at the correct moment in time to bring about the desired assembly of fins.

It is a further object of this invention to provide a mechanical tube expander, as aforesaid, which is easy to operate and permits simple compensation for minor part variations.

SUMMARY OF THE INVENTION

The objects and purposes of the invention are met by providing a mechanical tube expander for simultaneously expanding plural hairpin tubes or straight tubes into interlocked relationship with plural fins, the hairpin tubes each having a pair of straight leg portions and a bent portion connecting the straight leg portions. The mechanical tube expander includes a frame on which is provided a receiver adapted for supporting the bent portions of the hairpin tubes (or straight tubes) in an assembly of fins loosely stacked on the straight leg portions of the hairpin tubes. A support structure is also provided on the frame for engaging and supporting a first endmost fin or end sheet that is oriented immediately adjacent to but spaced from the receiver. A pressure plate carrying a plurality of expander rods is provided and each of the expander rods is aligned with the hairpin tubes. Each expander rod has a tube expanding structure at a distal end thereof for effecting an enlarging of the diameter of the straight leg portions of the hairpin tubes as the tube expanding structure is driven through the straight leg portions of the hairpin tubes. A stripper plate structure having plural guide openings therethrough is also provided. The expander rods extend through the guide openings. Structure is provided on the stripper plate for engaging a second endmost sheet or fin of the assembly of fins at an end thereof which is remote from the receiver. Separate drive devices are provided for effecting a selective and coordinated movement of each of the pressure plate, the stripper plate structure and the support structure relative to each other and in response to a movement of the expander rods and the tube expanding structure thereon into the straight leg portions of the hairpin tubes which effects an enlarging of the diameter of the straight leg portions to effect a fixing of each of the fins to the hairpin tubes.

BRIEF DESCRIPTION OF THE DRAWINGS

Other objects and purposes of this invention will be apparent to persons acquainted with apparatus of this general type upon reading the following specification and inspecting the accompanying drawings, in which.

Figure 1:
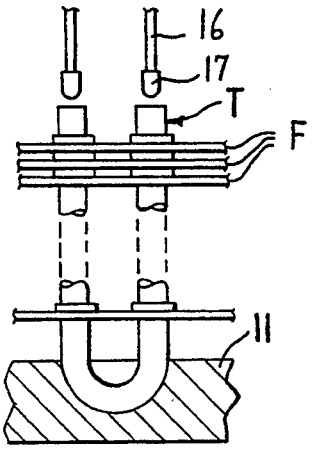
FIG. 1 is a fragmentary enlargement of an assembly of fins or fin pack mounted on a hairpin tube supported on a receiver.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

DETAILED DESCRIPTION

While the following description discusses a use of U-shaped hairpin tubes with straight leg portions, it is to be understood that this disclosure is also applicable for just straight tubes.

Referring now to the drawings, FIGS. 2–7 and 12 illustrate a first embodiment of a vertical tube expander 10 comprising a frame 12 on which a hairpin supporting receiver 11 is mounted. The tubes T and the fins F to be interlocked with the tubes (see FIG. 1) are disposed in a fixture 13. The tubes T are oriented vertically and the fins F are loosely stacked thereon. That is, the fins have punched holes therein which loosely receive the straight leg portions of the hairpin tubes therethrough. The hairpin supporting receiver 11 supports the reversely curved (hairpin bent) lower ends of the tubes. The receiver is supported on a receiver support plate 14 mounted on the lower portion of the frame 12, particularly on the upper surface of a bolster plate 15.

Figure 2:
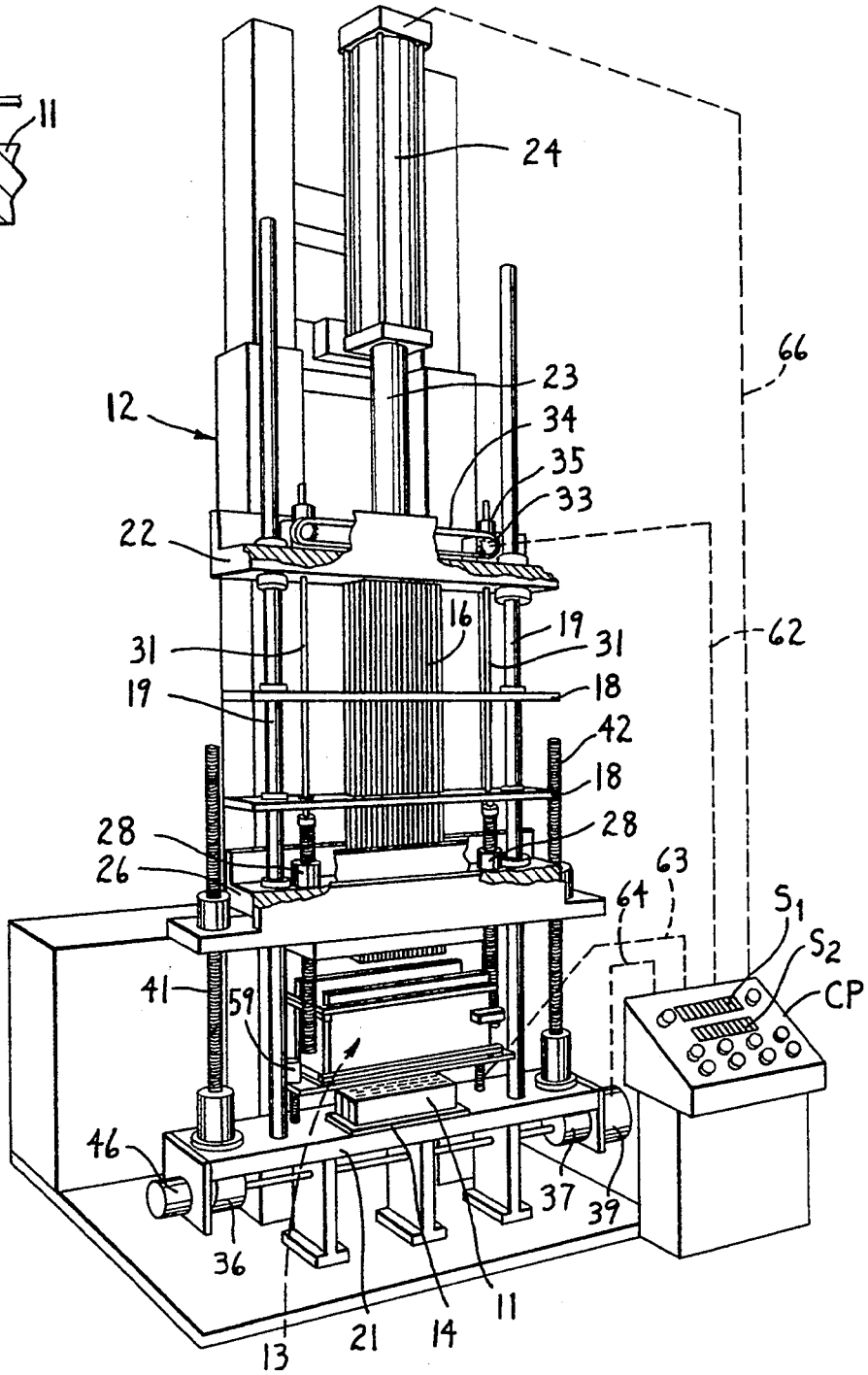
FIG. 2 is an isometric view of a mechanical tube expander embodying the invention.

A plurality of expander rods 16, corresponding in number and arrangement to the number and arrangement of tubes T, is provided for expanding the tubes. At their lower ends, the expander rods carry expander bullets 17 (see FIG. 1) which are effective to expand the tubes into interlocked engagement with the ID of the holes punched through the fins F when the expander rods are moved vertically downwardly through the tubes. The expander rods 16 extend through guide holes provided in plural, vertically moveable, guide plates 18, suspended from a pressure plate 22 by not illustrated tie rods, so that the intermediate portions of the expander rods will remain vertically aligned with the tubes T and will not bend or buckle when a compressive force is applied thereto. Vertical guide rods 19 are provided for guiding the reciprocating movement of other of the reciprocally movable parts of the mechanical tube expander, such as the pressure plate 22 and the guide plates 18. The vertical guide rods 19 are mounted on the sturdily constructed bolster plate 15 part of the frame 12 and extend vertically upwardly therefrom. The pressure plate 22 is provided for supporting the expander rods 16 for vertical reciprocating movement. The pressure plate 22 is vertically slidably guided by the rods 19. The pressure plate 22 is connected to a ram piston rod 23 of a piston and cylinder assembly schematically indicated by the reference character 24 so that the pressure plate 22 can be driven toward and away from the receiver 11. A final expander plate 26 is also vertically slidably movable on the guide rods 19. The final expander plate 26 has flaring implements 27 (FIG. 5) thereon for flaring or enlarging the upwardly facing open ends of the tubes T, particularly during the final stages of the stroke from the piston and cylinder assembly 24. A pair of internally threaded nuts 28 are mounted on the upper surface of the final expander plate 26 and each thereof threadedly receive therein an elongated pressure screw 29. Each pressure screw 29 has an elongated rod 31 extending upwardly therefrom through openings provided in the guide plates 18 and the pressure plate 22. Both of the pressure screws 29 are oriented so that the upper ends 32 are coplanar and remain coplanar as a motorized drive unit alters the vertical position thereof. Referring to FIG. 2, the motorized drive unit includes a reversible electric servomotor 33 mounted on the pressure plate 22 and, through an appropriate transmission mechanism 34, cause both pressure screws 29 to synchronously rotate and be moved upwardly or downwardly relative to the nuts 28 at the same rate thereby keeping the upper ends 32 of the screws in the aforesaid coplanar arrangement. An encoder 35 is provided to monitor the number of rotations of the pressure screws 29 and to thereby indicate the distance that the upper end of the screw 32 is from the bottommost position of the stroke for the piston and cylinder assembly 24.

Figure 3:
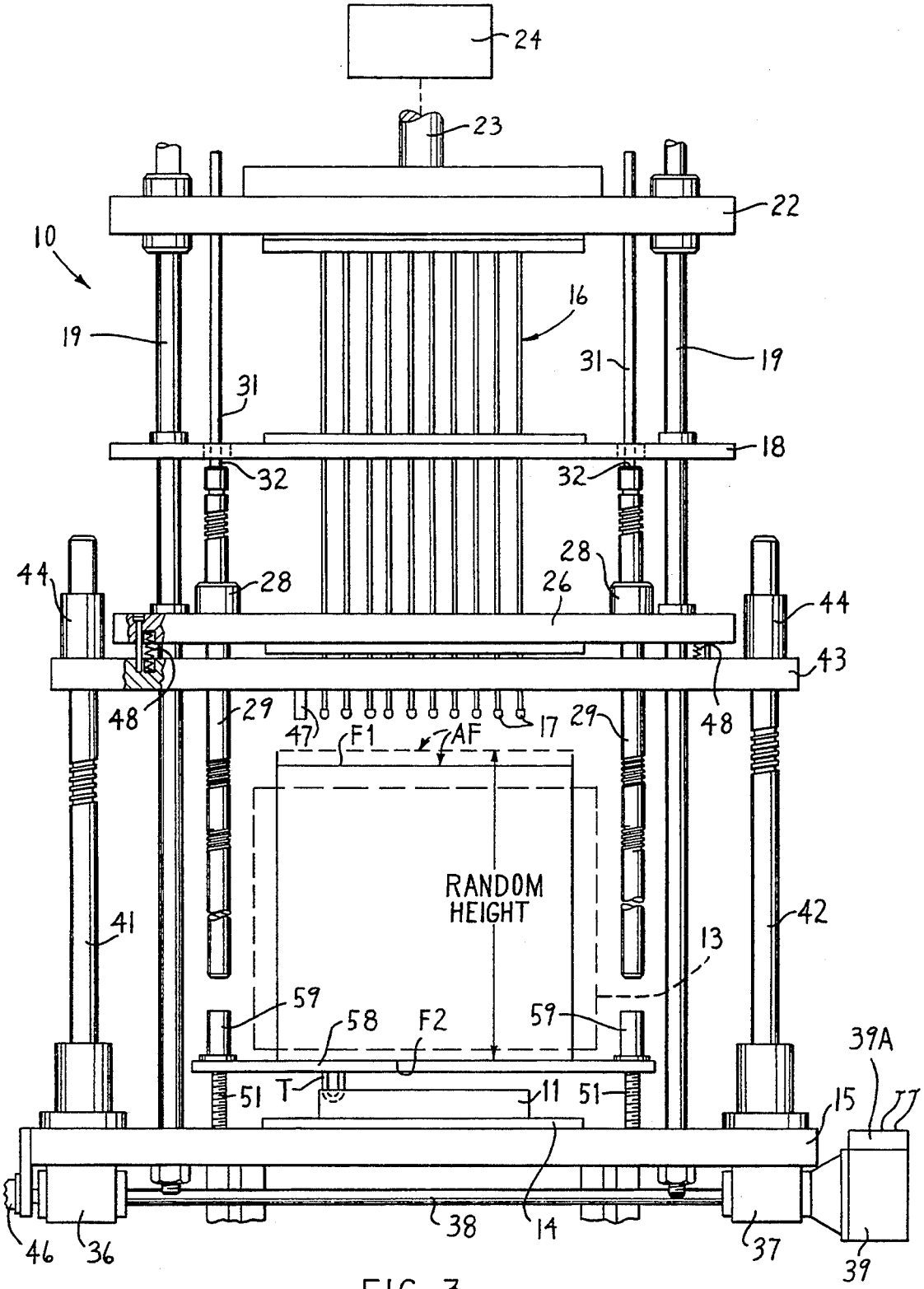
FIG. 3 is a front view of the mechanical tube expander illustrated in FIG. 2.

A pair of right angle drive transmissions 36 and 37 are mounted to the underside of the bolster plate 15 as illustrated in FIG. 3. The drive transmissions 36 and 37 are interconnected by a drive shaft 38 which in turn is driven for rotation by a reversible electric servomotor 39. Each drive transmission 36 and 37 has an output shaft drivingly coupled to a vertically upright screw 41 and 42, respectively. A stripper plate 43 has appropriate openings therethrough receiving the screws 41 and 42 therethrough. A pair of internally threaded nuts 44 are mounted on the upper surface of the stripper plate 43 and threadedly receive therein the elongated screws 41 and 42. An encoder 46 (FIGS. 2 and 4) is provided for monitoring the number of rotations of the screws 41 and 42 as well as the directions of rotation of the screws 41 and 42 so that the vertical position of the stripper plate 43 and the spacing of the stripper posts 47, particularly the lower ends thereof, from the upper surface of the receiver 11 is known at all times.

In this particular embodiment, the final expander plate 26 is urged upwardly away from the stripper plate 43 by a plurality of compressible members 48, such as springs. The extent to which the final expander plate 26 is urged away from the stripper plate 43 is determined by the enlarged heads of a plurality of bolts 49 screwed into the upper surface of the stripper plate 43, the heads of which bolts are larger in diameter than the diameter of a hole through which the stem of the bolt extends to the point of its threaded engagement with the stripper plate 43 as illustrated in FIG. 3.

In this particular embodiment, the stripper posts 47 are intended to engage the upper fin or end sheet F1 of an assembly of fins or fin pack AF for the purpose of setting the stack of fins loosely provided on the straight leg portions of the hairpin bends to a presize coil height PS illustrated in FIG. 4 and as will be explained in more detail below. The stripper posts 47 also engage the upper fin F1 so as to facilitate a removal of the bullets 17 from within the tubes T following an expansion of the tubes T into an interlocking relation with the fins F without lifting the assembly of fins AF.

A pair of additional rotatable screws 51 are provided on the bolster plate 15 and extend parallel to the screws 41 and 42. Referring to FIG. 4, the screws 51 are driven by a belt drive mechanism 52, preferably a toothed belt drive so that the belt 52 is mechanically interlocked to a pulley 53 drivingly coupled to the screws 51. Similarly, a drive pulley 54 connected to the output shaft of a reversible electric servomotor 56 has teeth on the peripheral surface thereof to operatively engage the teeth on the belt 52. The belt 52 could be, instead, a chain and the pulleys 53 and 54 could be sprockets operatively engaging the chain. An encoder 57 is provided on the electric servomotor 56 to track the number of and direction of revolutions of the motor 56 to monitor, therefore, the number of rotations of each of the screws 51. A support plate 58 is provided and has a pair of laterally spaced holes therein through which is received each screw 51. A pair of internally threaded nuts 59 are mounted on the upper surface of the support plate 58 and each threadedly receives therein an elongated screw 51. Thus, as the screws 51 are synchronously rotated, the support plate 58 is driven either upwardly or downwardly relative to the receiver 11.

OPERATION

While the operation of the mechanical tube expander 10 will be obvious to those skilled in the art, a brief explanation of the operation will be given for convenience.

Figure 12:
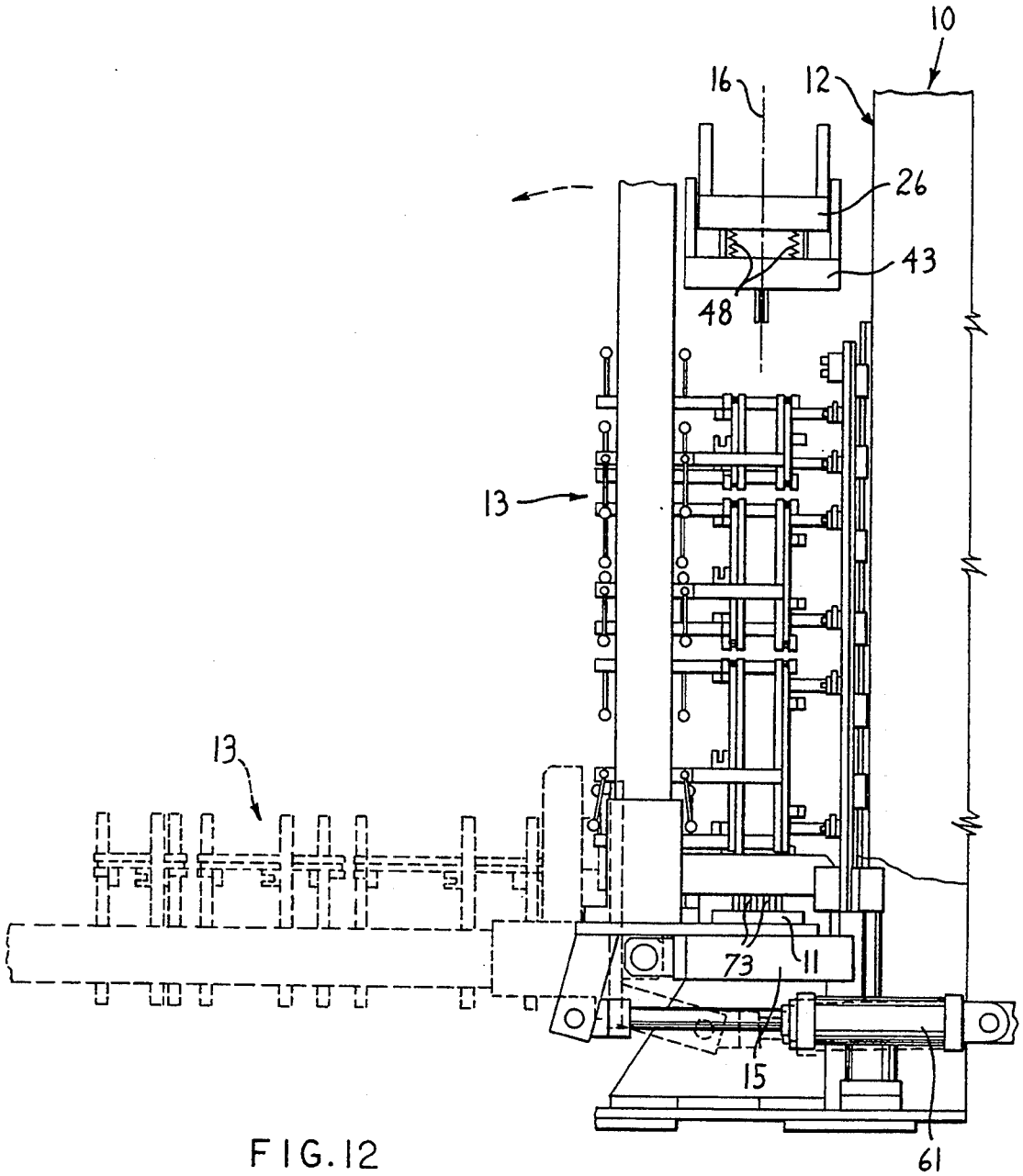
FIG. 12 is a side elevational view of the mechanical tube expander illustrated in FIG. 2.

When the component parts of the mechanical tube expander 10 are in the position illustrated in FIG. 3, the bullets 17 are spaced upwardly from the uppermost fin F1 of the assembly of fins AF which is to be assembled into a finished coil assembly. Referring to FIG. 12, a hairpin tube with a plurality of fins F laced thereon is placed into the fixture 13 when the fixture is in the broken line position illustrated in FIG. 12. Thereafter, the fixture 13 is moved to an upright position by an appropriate activation of a piston and cylinder assembly 61 mounted to the base of the frame 12 (see FIG. 12). This coil loading operation orients the lowermost fin F2 of the assembly of fins on the upper surface of the support plate 58. There are a multitude of other devices for loading an assembly of fins AF into the tube expander 10. The structure of FIG. 12 is representative of the many variations available to do the job. The stack of fins in the assembly of fins AF has, at this point in time, a random height. Further, the 180° bent portion on each of the hairpin tubes T sticks out of the bottom of the assembly of fins AF supported on the support plate 58 and rests in an appropriate pocket in the upper surface of the receiver 11. The individual fins of the fin pack are spaced from one another in a known manner, such as by providing a punched out sleeve encircling each opening. During a machine set up, the stripper plate 43 will have been driven by the screws 41 and 42 upwardly to the position illustrated in FIG. 3, namely, to a starting point. The final expander plate 26 is already urged upwardly away from the stripper plate 43 by the plurality of compressible spring members 48. The pressure screws 29 will also have been driven to an appropriate position so that the upper end surfaces 32 thereof will be oriented a known distance from the bottommost position of the stroke of the pressure plate 22. Generally, the uppermost end surfaces 32 of the pressure screws 29 are oriented a distance equal to the spacing between the final expander plate 26 and the stripper plate 43 from the bottommost stroke position of the pressure plate 22.

Referring to FIG. 2, a control panel CP is utilized by the machine operator to set the initial positions of the stripper plate 43 as well as the support plate 58. These two positions can be visibly indicated to the machine operator on screen displays S1 and S2. A display of the dimension representing the position of the surfaces 32 on the pressure screws 29 can also be provided in one of the screens S1 and S2 or a third screen (not shown) can be provided. A keyboard (not shown) is also provided on the control panel CP to allow the operator to type in a code number for a particular coil assembly. The code number will appear in one of the screen displays S1 or S2. Upon typing "enter", the servomotors 33, 39 and 56 will all be simultaneously driven to a starting position thereof causing, for example, the support plate 58 to be vertically adjusted by a rotation of the screws 51 caused by an operation of the electric servomotor 56 through the control line schematically illustrated at 63 (FIG. 2). Similarly, the screws 41 and 42 will be rotated by an operation of the electric servomotor 39 through the control line schematically illustrated at 64. The stroke of the piston-cylinder assembly 24 is regulated by a control provided through the control line schematically illustrated at 66. Generally, the piston-cylinder assembly 24 will retract to orient the pressure plate 22 at a position which will locate the bullets 17 in a position immediately adjacent the uppermost fin F1 of the assembly of fins AF as illustrated in FIG. 3 and to provide sufficient clearance to allow for the insertion of a filled fixture 13 into the machine (solid line position in FIG. 12) as has been described above. With all four drive axes now in proper orientation with respect to one another, that is, (1) the drive axis represented by the screws 41 and 42, (2) the drive axis represented by the support plate drive screws 51, (3) the drive axis corresponding to the position of the pressure screws 29 and (4) the drive axis representative of the piston-cylinder drive 24, the mechanical tube expander 10 is now ready for a cycle of operation. The operator can now initiate a cycle of operation by pushing a "cycle" button on the control panel.

Figure 8:
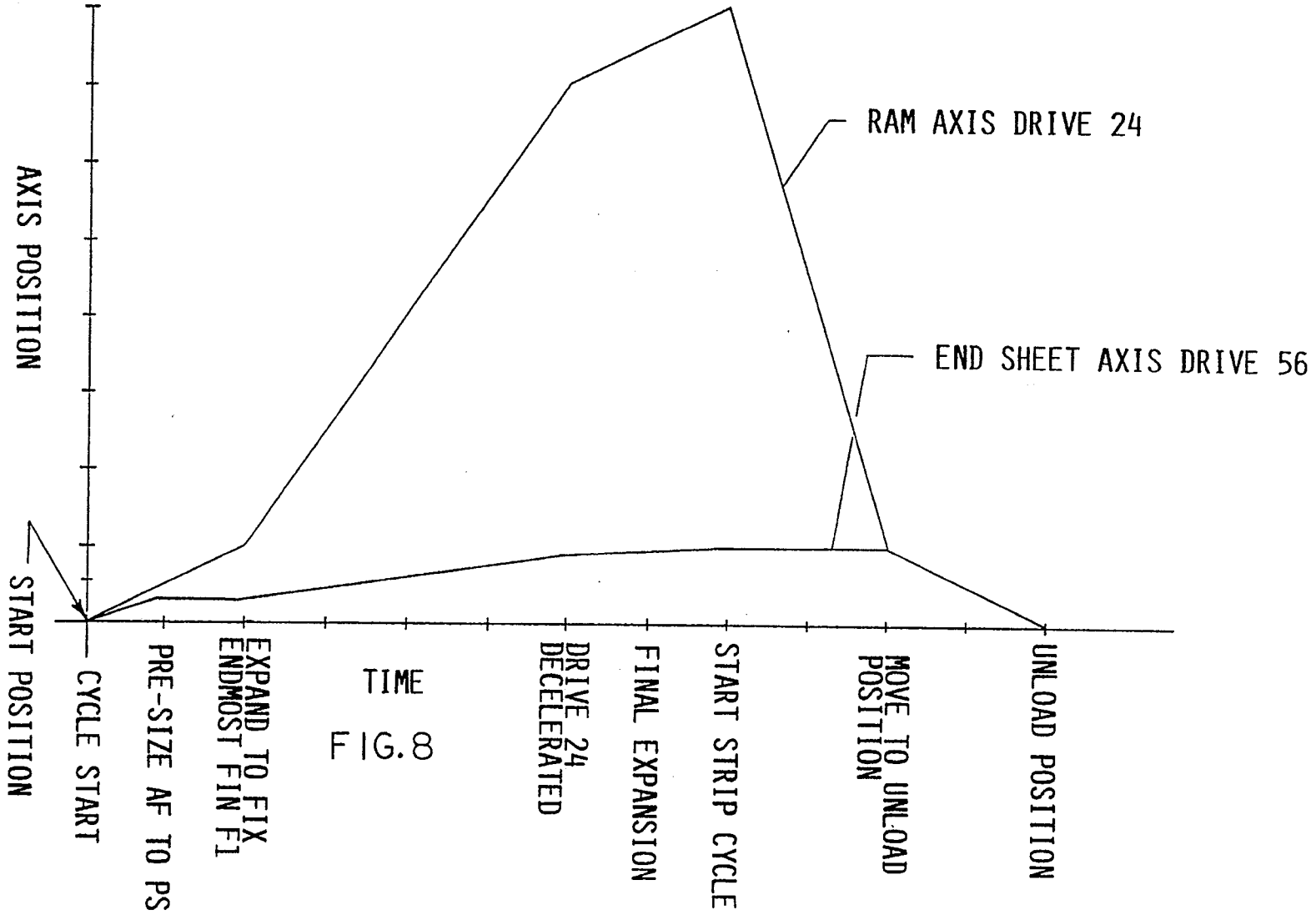
FIG. 8 is a graph illustrating the separate and coordinated movements of the pressure plate (Ram Axis) and the stripper plate (Stripper Plate Axis)
Figure 9:
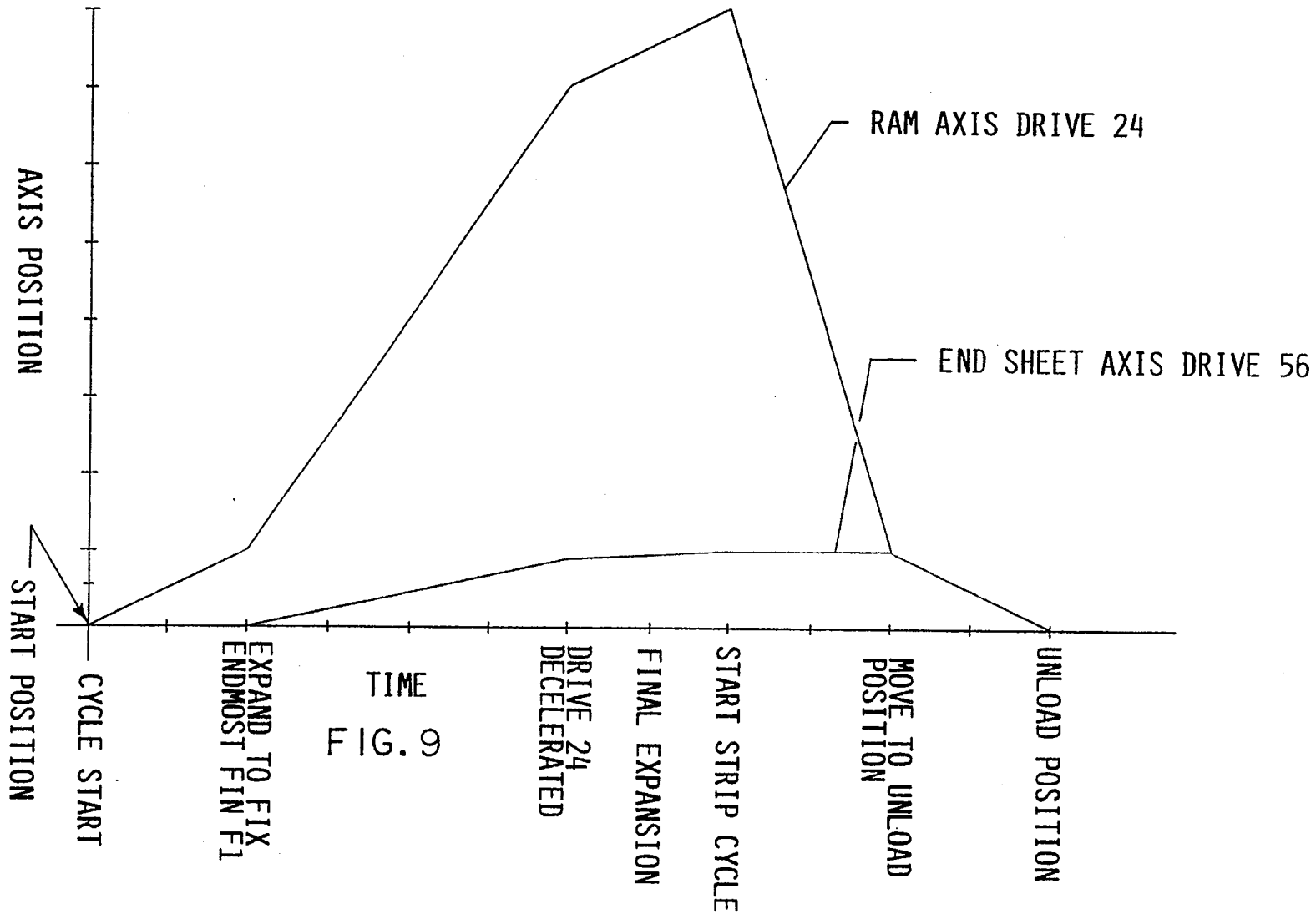
FIG. 9 is a graph illustrating the separate and coordinated movements of the pressure plate (Ram Axis) and the support structure for an endmost fin (End Sheet Axis)

The control panel CP contains appropriate previously programmed programming to control the sequential movements of the servomotors 39 and 56 for a multitude of different coil assemblies. The selection of a desired coil assembly by the operator keying in on a key pad the code number for the coil assembly brings into operation the set of commands controlling the servomotors and the piston-cylinder assembly 24. FIGS. 8 and 9 illustrate the preprogrammed set of movements of the servomotors 39 and 56 for controlling the positions of the stripper plate 43 and the support plate 58 in response to movements of the pressure plate 22 and the bullets 17 connected thereto.

Referring to FIGS. 8 and 9, the term "axis position" on the vertical ordinate indicates the position of the piston-cylinder assembly 24 (Ram Axis) or pressure plate 22 from its initial starting position as well as the position of the stripper plate 43 (controlled by the screws 41 and 42) from its initial start position. The horizontal ordinate of the graph represents time. In every instance, in this particular embodiment, the piston-cylinder assembly 24 drives the pressure plate 22 downwardly always to the same position so that the bullets 17 are oriented at approximately the upper surface of the receiver 11.

Figure 4:
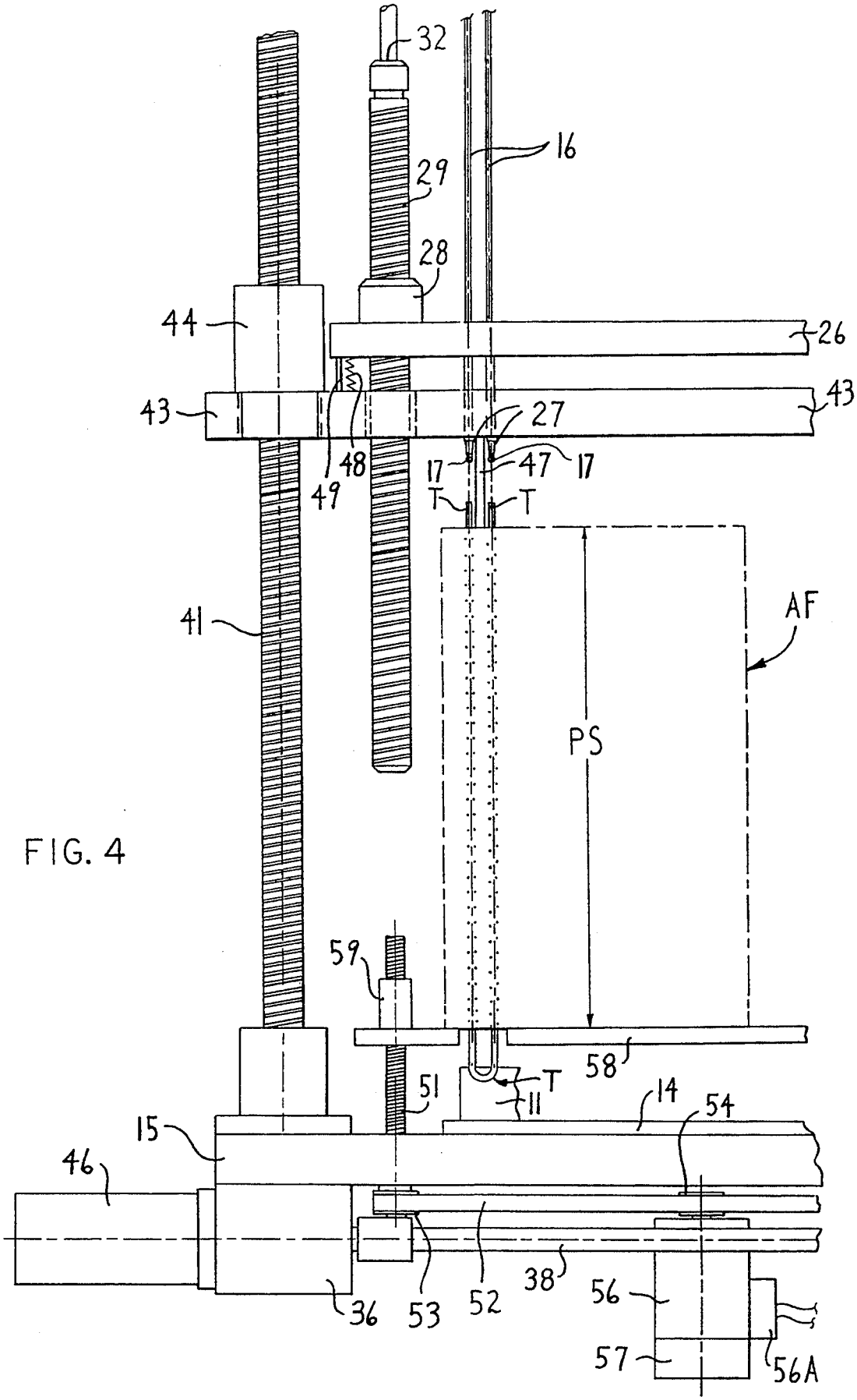
FIG. 4 is an enlarged fragment of the mechanical tube expander illustrated in FIG. 3 and at the start of a coil assembly operation.
Figure 5:
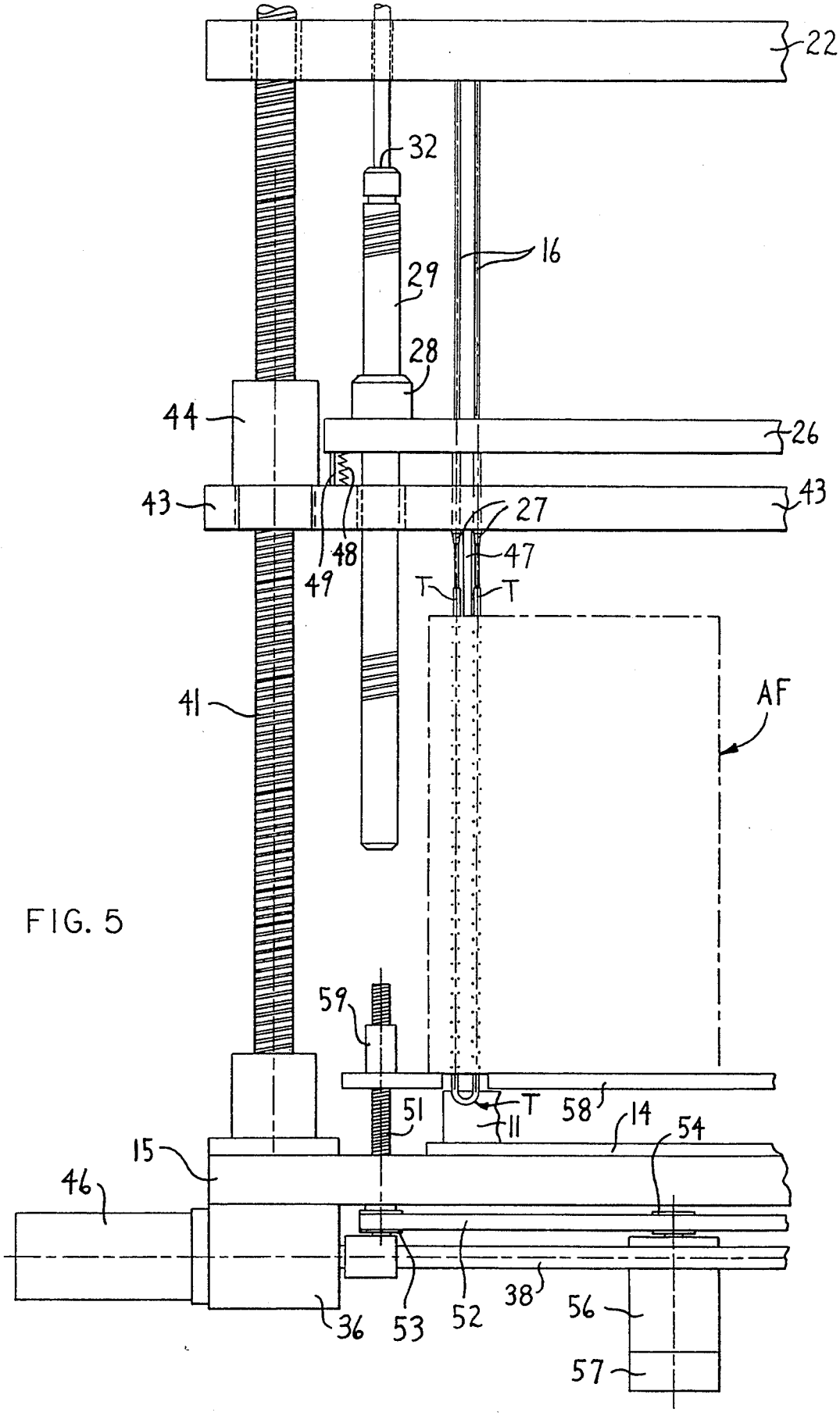
FIG. 5 is an enlarged fragment similar to FIG. 4, but where the assembly of fins or fin pack on the straight leg portions of the hairpin tubes has been compressed to a presize height.
Figure 6:
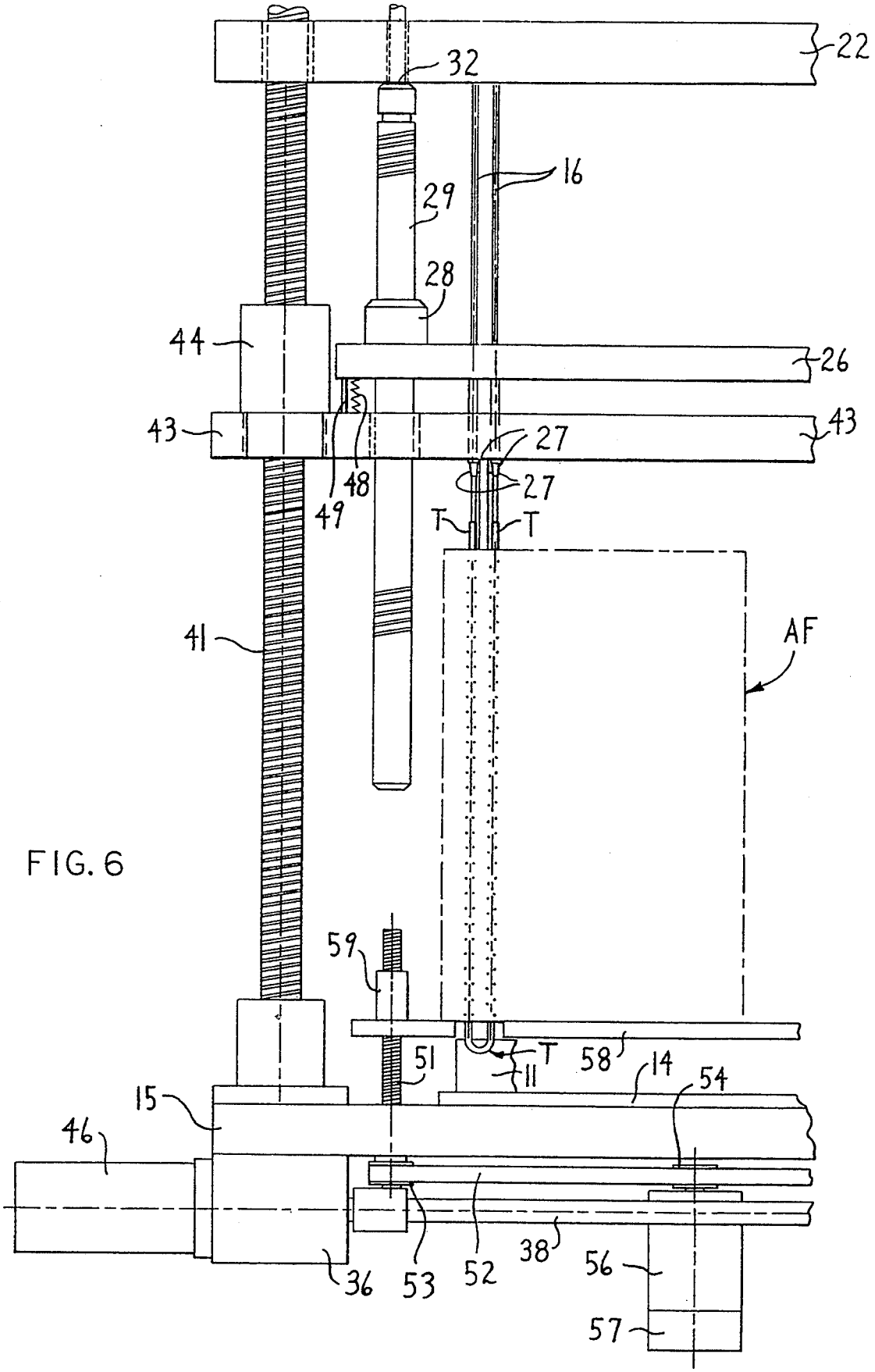
FIG. 6 is an enlarged fragment similar to FIG. 5 except that the pressure plate has been moved to a point where it engages the upper end of a pressure screw mounted on the final expander plate.
Figure 7:
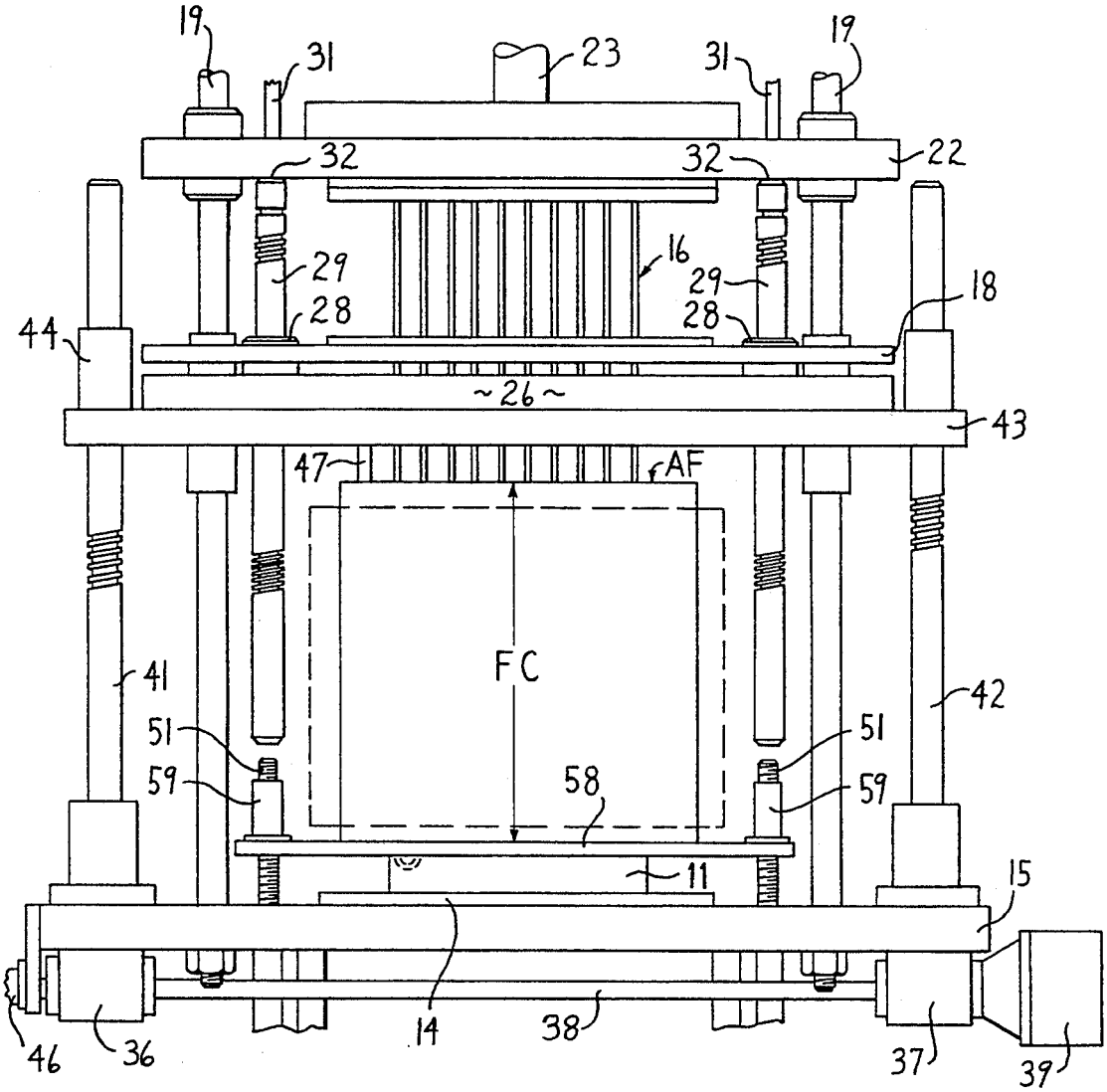
FIG. 7 is a front view of the mechanical tube expander illustrated in FIG. 2, but with the component parts thereof in a position whereat a finished assembled coil is created.

At the start of a cycle of operation, the piston-cylinder assembly 24 and the stripper plate drive 39 are simultaneously driven to bring the stripper posts 47 on the underside of the stripper plate 43 into engagement with the uppermost fin F1 of the assembly of fins AF to compress the assembly of fins to a presized dimension PS illustrated, for example, in FIG. 4. At this point in time, the bullets 17 have not yet entered the straight leg portions of the hairpin tubes T. Thereafter, however, further movement of the stripper plate 43 is halted but the piston-cylinder assembly 24 continues to drive toward its endmost stroke until the bullets 17 enter the upper ends of the hairpin tubes T. The speed of movement of the piston-cylinder assembly 24 is, in this particular embodiment, initially slow and remains at this speed until the uppermost or endmost fin F1 becomes affixed to the tube T by reason of an expansion of the outer diameter of the tube into engagement with the inner diameter of the hole punched through the fin F1. Thereafter, the piston-cylinder assembly 24 is driven at a more rapid rate toward the receiver 11 and the stripper plate 43 is moved also toward the receiver 11 at a rate that is electronically slaved to the position of the bullets inside the tubes. Generally, the total distance at which the stripper plate 43 is moved is equal to the rate at which the bullets 17 are moved through the tubes multiplied by the shrink rate of the tube T. The shrink rate is usually about 3%. During this continued movement of the bullets toward the receiver 11, the amount of "stick out" of the bent portion of the tube T moves closer to or is drawn toward the lowermost fin F2 of the assembly of fins AF. This can be readily seen by comparing the amount of "stick out" in FIGS. 4, 5 and 6. As a result, and as is illustrated by the graph in FIG. 9, the support plate 58 is driven toward the receiver 11 at about the point where bullets pass the uppermost fin F1. By comparing FIGS. 8 and 9, it will be noted that both the stripper plate 43 as well as the support plate 58 are moving slightly toward the receiver 11 as the overall length of the tubes T shrinks toward a finished length. During a shrinkage of the length of the tubes, the height of the fin pack AF will remain unchanged or actually grow, or decrease depending on the size of the fin pack AF to be assembled and the parameters at which the machine is set. Therefore, in situations where the fin pack will grow in height, the rate at which the support plate 58 advances toward the receiver 11 will differ from the rate at which the stripper plate 43 is moved toward the receiver 11. To compensate for the tube shrinkage rate and the fin pack growth rate is easily handled by the preprogrammed variation in rates of movement of the support plate 58 and stripper plate 43. Eventually, however, and referring to FIG. 5, the pressure plate 22 will approach the upper end surfaces 32 of the pressure screws 29. As shown in FIG. 6, the pressure plate 22 eventually abuts the upper end surface 32 of the pressure screws 29. However, and prior to the pressure plate 22 striking the upper end surfaces 32 of the pressure screws 29, the rate at which the piston-cylinder assembly 24 moves the pressure plate 22 is decelerated as shown by the graphs in FIGS. 8 and 9. However, the rates of movement of the support plate 58 and stripper plate 43 remain slaved to the position of the pressure plate 22 and the bullets 17 driven thereby. Further continued movement of the pressure plate 22 toward the receiver 11 will effect a compression of the springs 48 between the final expander plate 26 and the stripper plate 43 as the final expander plate 26 is urged toward the stripper plate 43. The flaring implements 27 on the final expander plate 26 are driven into the upper ends of the tubes T to flare the upper ends in a known manner. The amount or length of the final expansion is determined by the position of the stroke of the piston-cylinder assembly 24 at the moment in time that the pressure plate 22 contacts the pressure screws 29. As a result, and referring to FIG. 7, the assembly of fins or fin pack AF has a finished coil dimension FC and the bullets 17 are now oriented immediately adjacent the upper surface of the receiver 11. Further, and at this particular moment in the cycle, the strip cycle is now initiated, namely, a cycle to effect a removal of the bullets 17 from inside the straight leg portions of the hairpin tubes T. Retraction of the piston-cylinder assembly 24 is initiated with the stripper plate 43 remaining fixed all during the time that the bullets 17 are being pulled out of the tubes T. Once the bullets 17 are pulled free of the upper ends of the tubes T, the stripper plate is then returned toward its initial starting position, namely, a position that will enable the finished coil assembly to be unloaded from the fixture 13. It is also during this time that the support plate 58 is also moved to its initial starting position, thus stripping the completed coil from the nests for the 180° bends in the tubing in the receiver 11.

The beneficial feature of the four axis control is that each axis is independently driven and can be precisely controlled to accommodate any unexpected changes that might occur in the assembly operation, such as might be effected by different metals which will behave in slightly different and subtle ways as the bullets 17 are driven through the tubes T. As a result, the shapes of the graphs illustrated in FIGS. 8 and 9 can be subtlety adjusted to accommodate any coil that is in need of assembly.

Figure 14:
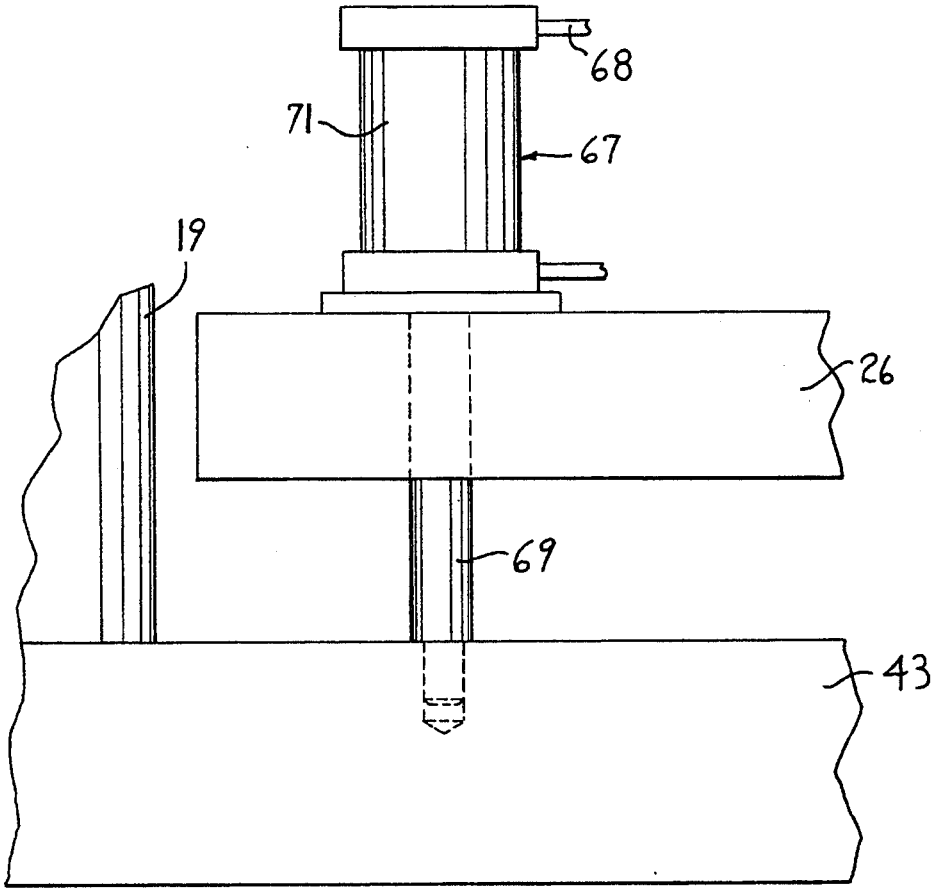
FIG. 14 illustrates a view similar to FIG. 13 but with the final expander plate having been separated from the stripper plate.
Figure 13:
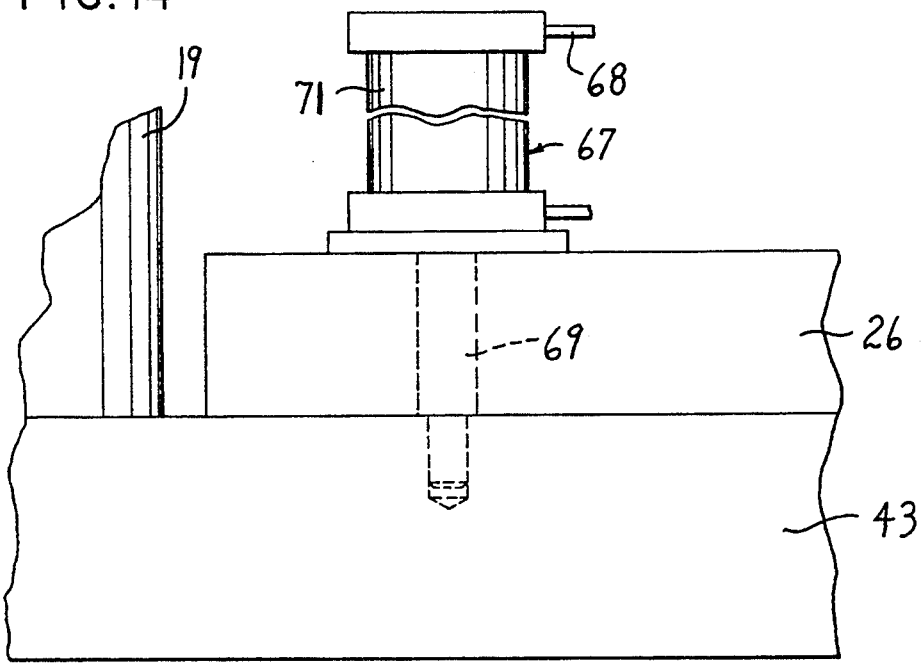
FIG. 13 is a further alternate embodiment illustrating a further drive mechanism for controlling the rate at which the final expander plate is urged away from the stripper plate following the completion of an assembly of fins.

Once the pressure plate 22 moves away from the upper end surface 32 of the pressure screws 29, the springs 48 will urge the final expander plate 26 away from the stripper plate 43. In some instances, however, the flaring implements 27 can remain stuck in the upper end of the tubes T and, as a result, the final expander plate 26 will be unable to be urged upwardly away from the upper surface of the stripper plate 43. Accordingly, it may be desirable to provide a further drive to force the final expander plate 26 away from the upper surface of the stripper plate 43. Such an additional drive is illustrated in FIGS. 13 and 14 in the form of a hydraulic piston-cylinder assembly 67 mounted on the final expander plate 26. When, for example, the final expander plate 26 is in engagement with the upper surface of the stripper plate 43 as illustrated in FIG. 13, pressurized fluid can be introduced at an inlet port 68 to the piston-cylinder assembly 67 to urge the piston rod 69 of the piston-cylinder assembly 67 toward an extended position thereof to drive the final expander plate 26 at a controlled rate upwardly away from the stripper plate 43. While the cylinder housing 71 of the piston-cylinder assembly 67 is mounted on the final expander plate 26 and the piston rod 69 secured to the stripper plate 43, it is to be recognized that this structure can be reversed.

ALTERNATE EMBODIMENT OF FIGS. 10–11

In the preceding embodiment, the pressure screws 29 were rotatably supported in internally threaded nuts 28 mounted on the upper surface of the final expander plate 26. In this particular embodiment, internally threaded nuts 72 are mounted on the upper surface of the pressure plate 22 and the pressure screws 29A are rotatably supported therein and depend downwardly from the undersurface of the pressure plate 22. In this particular embodiment, the lower end surfaces 32A of the two pressure screws 29A are maintained in a coplanar arrangement, similar to the manner in which the upper end surfaces 32 of the pressure screws 29 are maintained in a coplanar arrangement in the preceding embodiment. The servomotor 33 can effect a rotation of the pressure screws 29A, it being recognized that the specific location of the servomotor 33, the transmission 34 and the encoder 35 may have to be altered slightly to accommodate this alternate mounting of the pressure screws 29A.

Figure 11:
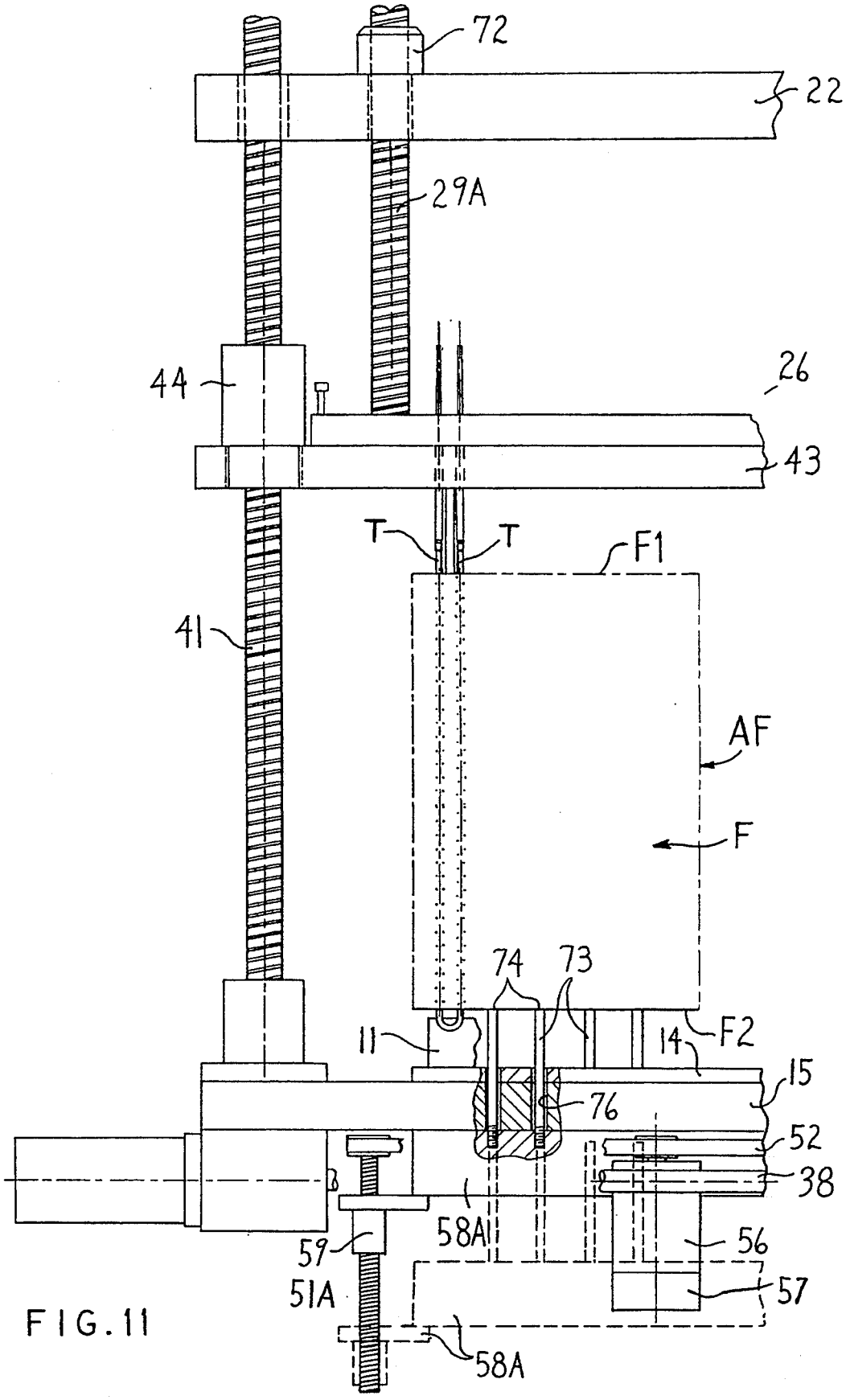
FIG. 11 is an enlarged fragment similar to FIG. 10 except that the final expander plate has been moved into engagement with the stripper plate.

In this particular embodiment, as the pressure plate 22 is driven downwardly by the piston-cylinder assembly 24, the lower end surfaces 32A of the pressure screws 29A will come into engagement with the upper surface of the final expander plate 26 to urge the final expander plate 26 toward the stripper plate 43 during the final expansion phase of the assembly, namely, that phase where the flaring implements 27 on the underside of the final expansion plate 26 are driven into the upper ends of the tubes T to flare or enlarge the diameter of the upper ends of the tubes T. Such movement will continue until the piston-cylinder assembly 24 reaches its lowermost stroke to orient the bullets 17 immediately adjacent the receiver 11 at which time the final expander plate 26 engages the upper surface of the stripper plate 43 as illustrated in FIG. 11. The operation of this assembly is virtually identical to the operation of the assembly described with respect to the preceding embodiment.

Figure 10:
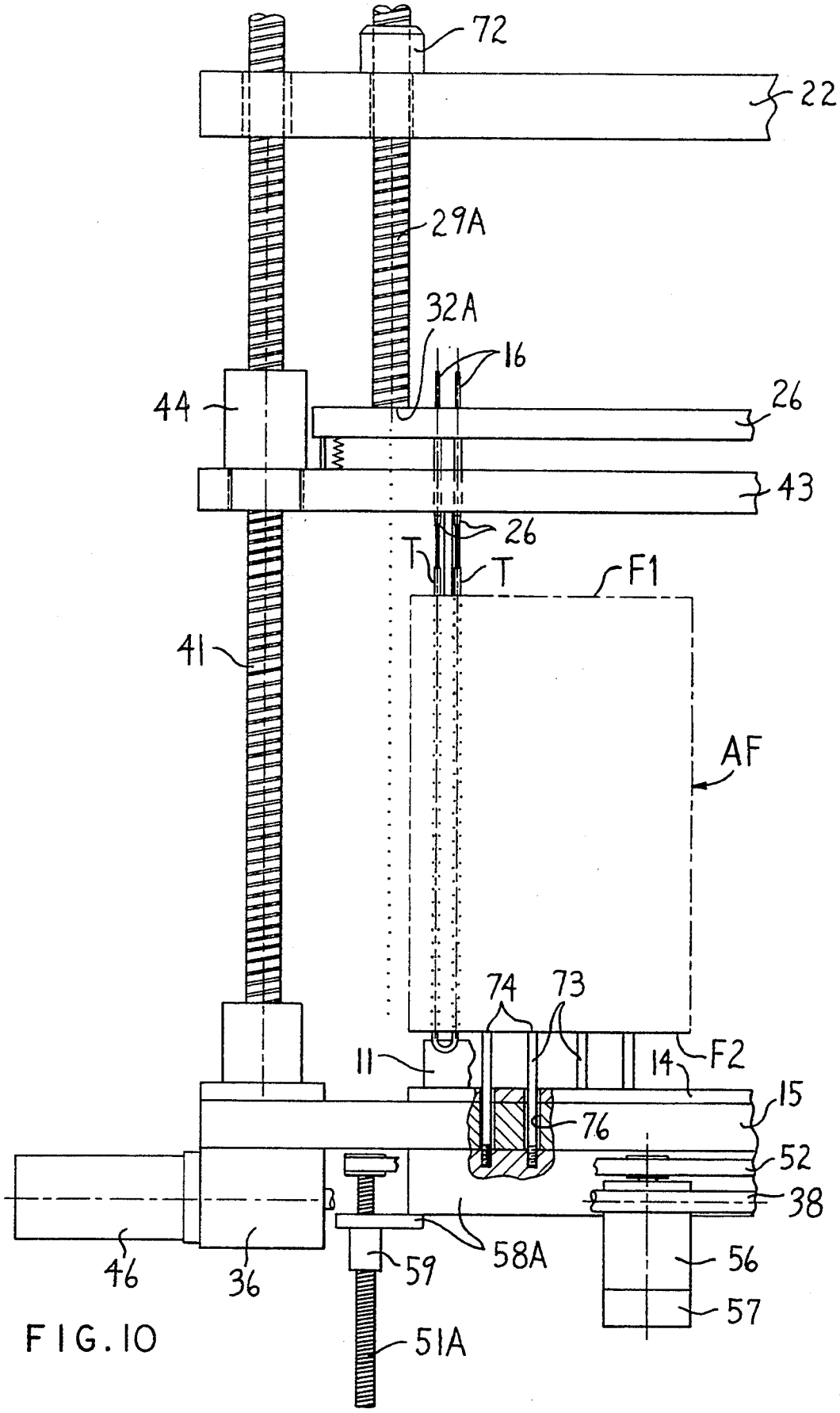
FIG. 10 is an enlarged fragment of an alternate embodiment of the spacer member, the spacer member being mounted on the pressure plate rather than the final expander plate as illustrated in the preceding embodiment.

FIGS. 10 and 11 show also an additional embodiment relating to the support of the lowermost fin F2 of the assembly of fins AF. In this particular embodiment, the support plate 58 described in the preceding embodiment is moved to a new position beneath the bolster plate 15. This new position of the support plate is indicated by the reference numeral 58A. The screws 51A for effecting an elevation of the support plate 58A are driven and controlled by circuitry and components that are virtually identical to the structure described in the preceding embodiment. A plurality of pins 73 are provided on the upper surface of the support plate 58A and extend upwardly therefrom so that the upper end surfaces 74 thereof are coplanarly arranged as illustrated in FIGS. 10 and 11. Appropriate guide holes 76 are provided in the bolster plate 15 to enable the pins 73 to project upwardly from the support plate 58A to a position to support the lowermost fin F2 in the assembly of fins. Further, the receiver 11 will need to be provided with corresponding passageways for the pins 73. The support plate 58A located beneath the bolster plate 15 can now be lowered away from the underside of the bolster plate 15 to pull the pins 53 to a neutral position located beneath the bolster plate 15 so that the fixture 13 can be pivoted to the broken line position without interference from the pins 73.

Throughout the foregoing assembly task, the preprogrammed operation of the servomotors 39 and 56 will cause a forced shrinkage of the straight leg portions of the tubes T beyond the normal shrink dimension. That is, if the normal shrink rate of the tubes T is 3%, the relative positions of the stripper plate and the receiver 11 as well as between the support plate 58 or surfaces 74 of the pins 73 and the receiver 11 can be programmed to force a regulated shrink of 3.1% or the like so that any variations in material behavior as the assembly progresses will be brought to proper tolerance by the final forced shrinkage operation.

In addition, the load applied to the support plate 58 (or 58A) and the stripper plate can be monitored by measuring devices 39A (FIG. 3) and 56A (FIG. 4) for measuring the torque load applied to the screws 51 (or 51A). The measuring devices 39A and 56A can be in the form of an electrical current monitors for monitoring the current required to drive the servomotors 39 and 56. As a result, if an assembly of fins AF unexpectedly encounters a problem during assembly, or the wrong assembly of fins AF inadvertently gets placed into the machine, the current load required to drive the servomotors 39 and 56 would immediately signal the problem to enable the machine to be halted before major damage is done to the machine. Such measuring devices will also facilitate diagnostics work enabling the preparation of more accurate preprogramming.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mechanical tube expander for simultaneously expanding straight leg portions of plural hairpin tubes or plural straight tubes into interlocked relationship with plural fins, said tube expander comprising:

a frame means;

a receiver means mounted on said frame means for supporting one end of the straight leg portions of the tubes in an assembly of fins loosely stacked on the straight leg portions;

a support means for engaging and supporting a first endmost fin that is oriented immediately adjacent to said receiver;

a pressure plate carrying a plurality of expander rods which are aligned with the straight leg portions of the tubes, said expander rods each having a tube-expanding means at a distal end thereof for enlarging the diameter of the straight leg portions of the tubes;

a stripper plate means having plural guide openings therethrough through which extend said expander rods, said stripper plate means engaging a second endmost fin at an end of the assembly of fins remote from said receiver;

separate drive means for effecting a selective and coordinated movement of each of said pressure plate, said stripper plate means and said support means relative to each other and in response to a movement of said expander rods and said tube expanding means thereon into said straight leg portions of the tubes to effect an enlarging of the diameter of the straight leg portions to effect a fixing of each of said fins to said tubes.

2. The mechanical tube expander according to claim 1, wherein said separate drive means includes a first drive mechanism for effecting a movement of said support means relative to said receiver to control a rate at which a stick out of the one ends of the straight leg portions on each of said tubes moves toward said first endmost fin as the tubes are expanded to maintain a sufficient support for the tubes as the tube expander means is moved into the straight leg portions.

3. The mechanical tube expander according to claim 1, wherein said separate drive means includes a second drive mechanism for effecting a movement of said pressure plate and the expander rods thereon toward and away from said receiver and the assembly of fins loosely stacked on the tubes.

4. The mechanical tube expander according to claim 1, wherein said separate drive means includes a third drive mechanism for effecting a movement of said stripper plate means toward and away from said receiver and the second endmost fin of the assembly of fins.

5. The mechanical tube expander according to claim 1, wherein said separate drive means includes a first drive mechanism for effecting a movement of said support means toward and away from said receiver and the first endmost fin of the assembly of fins.

6. The mechanical tube expander according to claim 1, wherein said stripper plate means includes a stripper plate and a final expander plate supported on said stripper plate for relative movement with respect thereto, said stripper plate including first means for engaging said second endmost fin of the assembly of fins, said final expander plate having second means thereon for expanding the diameter of exposed free ends of the straight leg portions of the tubes.

7. The mechanical tube expander according to claim 6, wherein said separate drive means includes an elongatable spacer means oriented between said pressure plate and said final expander plate and a fourth drive mechanism for adjusting a length dimension of said spacer means oriented between said pressure plate and said final expander plate.

8. The mechanical tube expander according to claim 7, wherein at least one of said final expander plate and said stripper plate includes means thereon for separating said final expander plate from said stripper plate; and wherein said elongatable spacer means is connected to one of said pressure plate and said final expander plate so that a distal end thereof is engageable with an other of said pressure plate and said final expander plate as said pressure plate moves toward said receiver so as to effect an urging of said final expander plate against said stripper plate.

9. The mechanical tube expander according to claim 1, wherein said separate drive means for effecting a selective and coordinated movement of each of said pressure plate, said stripper plate and said support means relative to each other includes separate sets of drive screws and drive motors therefor, said drive motors rotating said drive screws to effect an altering of the relative positions of said pressure plate, said stripper plate and said support means.

10. The mechanical tube expander according to claim 9, wherein a first set of said drive screws for effecting an altering of the position of said stripper plate are rotatably supported on said frame means and extend along axes that are parallel to an axis of movement of said pressure plate, said stripper plate being threadedly engaged with said drive screws and oriented on a side of the assembly of fins remote from said receiver.

11. The mechanical tube expander according to claim 10, wherein a second set of said drive screws for controlling the relative position of said support means are rotatably supported on said frame means and extend along axes that are parallel to said axes of said first set of said drive screws which effect a controlling of the position of the stripper plate so that a controlled movement of said first and second set of said drive screws will bring about an altering and a reduction in the spacing between said stripper plate and said support means as said straight leg portions of the tubes are sequentially fixed to the fins in the assembly of fins.

12. The mechanical tube expander according to claim 9, wherein said stripper plate means includes a stripper plate and a final expander plate supported on said stripper plate for relative movement with respect thereto, said stripper plate including first means for engaging said second endmost fin of the assembly of fins, said final expander plate having second means thereon for expanding the diameter of exposed free ends of the straight leg portions of the tubes; and wherein a further means is provided for urging the final expander plate away from the stripper plate during a stripping of the expander rods from the tubes.

13. The mechanical tube expander according to claim 12, wherein said further means is an elastically compressible member.

14. The mechanical tube expander according to claim 13, wherein said elastically compressible member is a spring.

15. The mechanical tube expander according to claim 12, wherein said further means is a piston-cylinder arrangement for forcibly driving said final expander plate away from said stripper plate.

16. The mechanical tube expander according to claim 9, wherein said separate drive means for said support plate includes a support plate having a plurality of upstanding pins thereon, the upper end surfaces of the pins being coplanar and supporting the first endmost fin of the assembly of fins thereon; and wherein appropriate passageways are provided in said frame means to facilitate passage of said pins therethrough so that said endmost surfaces of said pins can be retracted through said passageways by said drive means controlling the position of said support means.

17. The mechanical tube expander according to claim 1, wherein said stripper plate means includes a stripper plate and a final expander plate supported on said stripper plate for relative movement with respect thereto, said stripper plate including first means for engaging said second endmost fin of the assembly of fins, said final expander plate having second means thereon for expanding the diameter of exposed free ends of the straight leg portions of the tubes; and wherein said separate drive means includes an elongatable spacer means oriented between said pressure plate and said final expander plate and a fourth drive mechanism for adjusting the length dimension of said spacer means oriented between said pressure plate and said final expander plate; and wherein said fourth drive mechanism includes an internally threaded nut mounted on said final expander plate and an elongated drive screw threadedly engaged therewith, the portion of said drive screw extending between said final expander plate and said pressure plate defining said elongatable spacer means.

18. The mechanical tube expander according to claim 1, wherein said stripper plate means includes a stripper plate and a final expander plate supported on said stripper plate for relative movement with respect thereto, said stripper plate including first means for engaging said second endmost fin of the assembly of fins, said final expander plate having second means thereon for expanding the diameter of exposed free ends of the straight leg portions of the tubes; and wherein said separate drive means includes an elongatable spacer means oriented between said pressure plate and said final expander plate and a fourth drive mechanism for adjusting the length dimension of said spacer means oriented between said pressure plate and said final expander plate; and wherein said fourth drive mechanism includes an internally threaded nut mounted on said pressure plate and an elongated drive screw threadedly engaged therewith, the portion of said drive screw extending between said pressure plate and said final expander plate defining said elongatable spacer means.

* * * * *